US006607158B1

(12) United States Patent
Fischer

(10) Patent No.: US 6,607,158 B1
(45) Date of Patent: Aug. 19, 2003

(54) UNWINDING APPARATUS

(75) Inventor: Charles Fischer, Wohlen (CH)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/610,220

(22) Filed: Jul. 3, 2000

(30) Foreign Application Priority Data

Jul. 26, 1999 (DE) ..... 199 35 051

(51) Int. Cl.[7] ..... B65H 23/06
(52) U.S. Cl. ..... 242/420.1; 242/563; 242/564.5
(58) Field of Search ..... 242/420.1, 420.3, 242/420.2, 564.5, 566, 421.8, 563, 564.1

(56) References Cited

U.S. PATENT DOCUMENTS 3,279,717 A * 10/1966 Schubert ..... 242/566
3,408,020 A 10/1968 Scott
4,530,471 A * 7/1985 Inoue ..... 242/420.1

FOREIGN PATENT DOCUMENTS

DE 2-824-433 A 12/1979
DE 4-206-330 A 9/1993

* cited by examiner

*Primary Examiner*—John Q. Nguyen
(74) *Attorney, Agent, or Firm*—Oliff & Berridge, PLC

(57) ABSTRACT

An unwinding apparatus (10) for a strapping machine (12) for the purpose of unwinding a band (14) from a band-supply reel (16) comprises at least two bearing rollers (20, 22) which are located one behind the other in the circumferential direction of the band-supply reel (16) and on which the band-supply reel (16) rests by way of its respective outer band circumference, it being possible for at least the downstream bearing roller (22) to be driven for the purpose of driving the band-supply reel (16).

8 Claims, 2 Drawing Sheets

UNWINDING APPARATUS

BACKGROUND OF THE INVENTION

The invention relates to an unwinding apparatus for a strapping machine for the purpose of unwinding a band from a band-supply reel.

Such an unwinding apparatus is used to supply the relevant strapping machine with the band material which is required therein for the purpose of strapping a respective item which is to be strapped.

In a known unwinding apparatus of the type mentioned in the introduction, a relatively small band-supply reel is clamped in between two rolling flanges which are connected to one another via a threaded shank with associated nut. The rolling flanges are located on two rollers, of which one is driven. Accordingly, at constant drive speed, the band length unwound per unit of time decreases correspondingly as the band-supply reel becomes smaller. The unwound band is fed into a box-like supply container, from which the strapping machine draws off the band. The band supply lies in an unordered fashion in the supply container, and the band which is conveyed rearward by way of the strapping machine hangs out. Side walls which are considerably lower than the rolling flanges are provided. In addition to a reduced guiding action, there is thus also a certain risk of accident since undesired contact between the rotating parts cannot be ruled out.

SUMMARY OF THE INVENTION

The object of the invention is to provide an improved unwinding apparatus of the type mentioned in the introduction, in which the abovementioned disadvantages are eliminated.

This object is achieved according to the invention by at least two bearing rollers which are located one behind the other in the rotational direction of the band-supply reel and on which the band-supply reel rests by way of its respective outer band circumference, it being possible for at least the downstream bearing roller to be driven for the purpose of driving the band-supply reel.

This design also makes it possible to use, in particular, larger band-supply reels. Since the band-supply reel rests directly on the bearing rollers by way of its respective outer band circumference, the speed of unwinding from the band-supply reel, at constant rotational speed of the drive, is always the same irrespective of the diameter of said band-supply reel. Even relatively large and heavy band-supply reels can be handled easily. The relevant reels can provide an extremely large band supply. The necessary outlay in control terms is minimal.

The downstream bearing roller is expediently provided with a rubber casing. By virtue of such a rubber casing on the downstream bearing roller, it is possible, in particular when the two bearing rollers are driven, to prevent band sections from bulging out between said two rollers. By virtue of the increased friction between the rubber casing and the band-supply reel, the downstream bearing roller has a drive-determining function. This is the case, in particular, when the upstream bearing roller has a surface made of, for example, steel, with the result that said upstream bearing roller serves predominantly for bearing purposes. It is thus also conceivable, in particular, for merely the downstream bearing roller to be driven.

The unwinding apparatus expediently comprises two fixed side walls which are preferably no less than the height as the band-supply reel and between which it is possible to introduce the band-supply reel, which is to be lowered onto the bearing rollers. The side walls give the band-supply reel the desired stability. It is also conceivable to roll the band-supply reel onto the bearing rollers between the side walls.

The side walls may be provided with recesses which are open in the upward direction and extend into the region of a central cavity of the band-supply reel, said cavity being defined, in particular, by a hollow-cylindrical core. It is thus the case that, with the band-supply reel set down, the central cavity of the latter is accessible in order for it to be possible, for example, for a carrying strap by means of which the band-supply reel was previously fastened on a crane to be removed again.

In a preferred practical embodiment, the unwinding apparatus comprises an intermediate band store via which the band unwound from the band-supply reel is fed to the strapping machine and kept taut. Since the band is always kept taut by the intermediate band store, the situation where band which is conveyed rearward by way of the strapping machine hangs out is ruled out.

The drive of the band-supply reel can expediently be activated in dependence on the respective state of the intermediate band store and/or the quantity of band material stored in the intermediate band store. It is thus possible to prevent continued unwinding of band material once the drawing-in operation of the band in the region of the strapping machine has been stopped.

It is advantageous for at least one weight lever to be provided in order to load the band-supply reel, which rests on the bearing rollers, downward in the direction of the bearing rollers. This ensures that the band-supply reel, which becomes increasingly lighter in the direction of the end of the supply, or the remaining core does not spring off from the bearing rollers. The weight lever may be mounted, for example, pivotably on the fixed side walls.

The band unwound from the band-supply reel is expediently guided generally upward to the intermediate band store.

In a preferred practical embodiment of the unwinding apparatus according to the invention, the intermediate band store, in the manner of a block and tackle, comprises at least two deflecting rollers over which the unwound band is guided, with a reserve band supply being formed in the process, there being provided at least one top deflecting roller, which is mounted in a stationary manner, and at least one bottom deflecting roller, which can be displaced in the vertical direction.

In this case, the bottom deflecting roller may be mounted, in particular, on a carriage which can be displaced in the vertical direction along, a carriage guide.

The drive of the band-supply reel can advantageously be activated depending upon the vertical position of the bottom deflecting roller or of the carriage. In this case, said drive of the band-supply reel is expediently activated such that it is switched on if the bottom deflecting roller or the carriage assumes a predeterminable position, or is located above the same, and is switched off if the bottom deflecting roller or the carriage is located beneath said predeterminable position.

For the purpose of monitoring the vertical position of the bottom deflecting roller or of the carriage, at least one sensor is expediently provided. In this case, it is possible to provide, in particular, at least one vertically adjustable sensor preferably assigned to the carriage guide.

The circumferential speed of the at least one driven bearing roller is essentially equal to the speed at which the band is drawn into the strapping machine. With the drive of the band-supply reel switched on, the situation where more band material than is required by the strapping machine is supplied is thus prevented.

BRIEF DESCRIPTION OF DRAWINGS

The invention is explained in more detail hereinbelow by way of an exemplary embodiment and with reference to the drawing, in which.

DETAILED DESCRIPTION OF THE PREFERRED EMBODIMENTS

Figures 1, 2, 3:
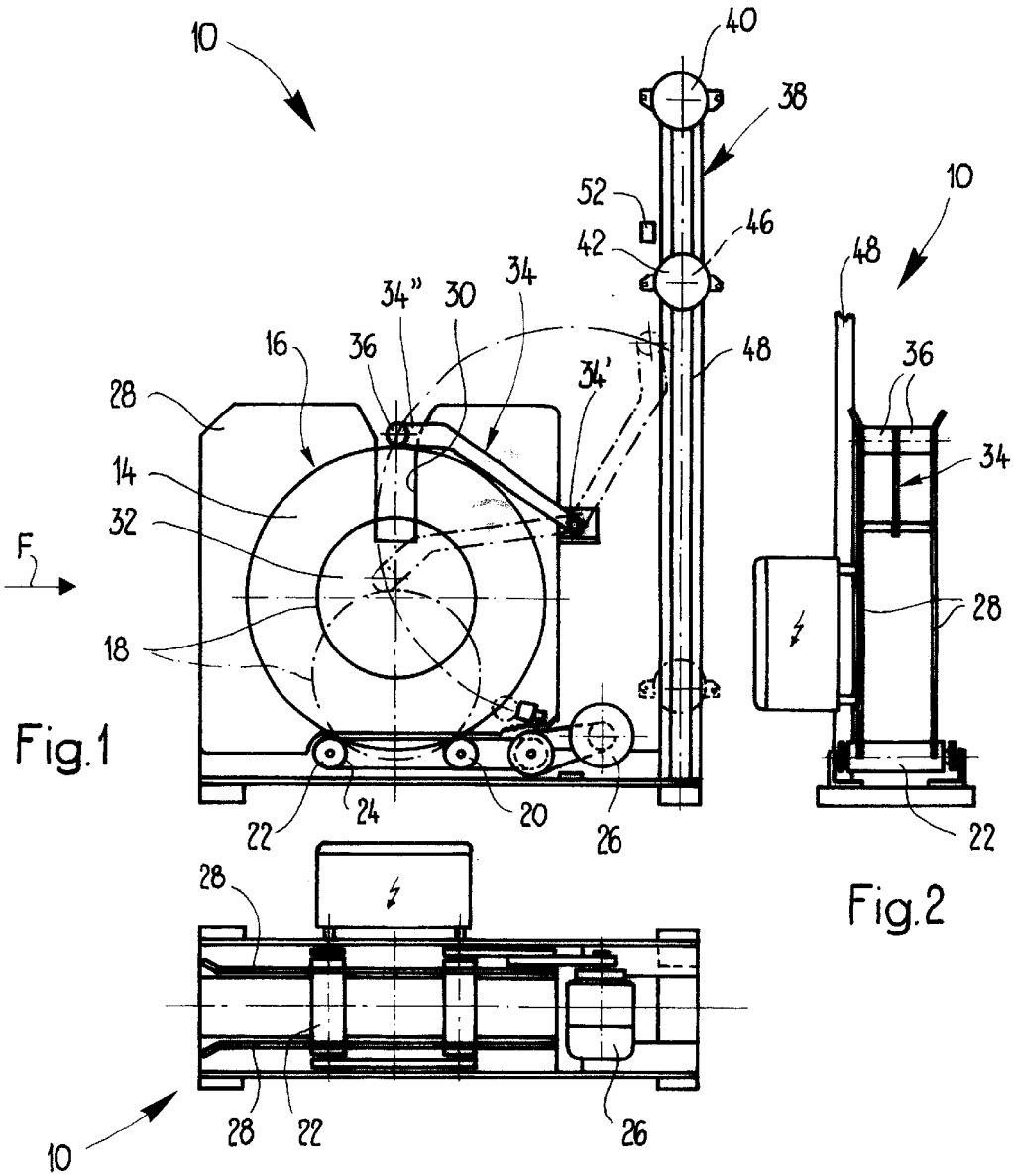
FIG. 1 shows a schematic side view of the unwinding apparatus.
FIG. 2 shows a schematic end view of the unwinding apparatus in the direction of the arrow F from FIG. 1.
FIG. 3 shows a schematic plan view of the unwinding apparatus without band-supply reel.

FIGS. 1 to 4 show purely schematic illustrations of an unwinding apparatus 10 for a strapping machine 12 (see FIG. 4) for the purpose of unwinding a, for example, plastic band 14 from a band-supply reel 16.

In the present case, the band-supply reel 16 has a hollow-cylindrical core 18 which may consist, for example, of hard cardboard and onto which the band supply is wound.

In the present exemplary embodiment, use is made of large band-supply reels, for example so-called jumbo coils with to approximately 4000 m of plastic band wound up thereon.

The unwinding apparatus 10 comprises at least two bearing rollers 20, 22 which are located one behind the other in the rotational direction of the band-supply reel 16 and on which the band-supply reel 16 rests directly by way of its respective outer band circumference.

In the exemplary embodiment illustrated, the two bearing rollers 20, 22 are driven at the same circumferential speed. The downstream bearing roller 22, however, is provided with a rubber casing 24, while the surface of the upstream bearing roller 20 composed of steel. By virtue of the friction between the rubber casing 24 and the supply reel 16 being greater than that between the steel casing and the band-supply reel 16, the downstream bearing roller 22 has a drive-determining function for the band-supply reel 16, while the upstream bearing roller 20 serves predominantly for bearing purposes. It is thus also conceivable, in particular, for merely the downstream bearing roller 22 to be driven.

As can be seen, in particular, with reference to FIGS. 1 and 3, in the present exemplary embodiment, an electric drive motor 26 drives the upstream bearing roller 20 and, the downstream bearing roller 22.

The unwinding apparatus 10 also comprises two fixed side walls 28 which are produced, for example, from sheet metal and may preferably be approximately the same height as the band-supply reel 16. In the present case, said side walls 28 project upward some way beyond the band-supply reel 16.

The band-supply reel 16 is introduced between the side walls 28, and lowered onto the two bearing rollers 20, 22, for example by means of a crane.

Figure 4:
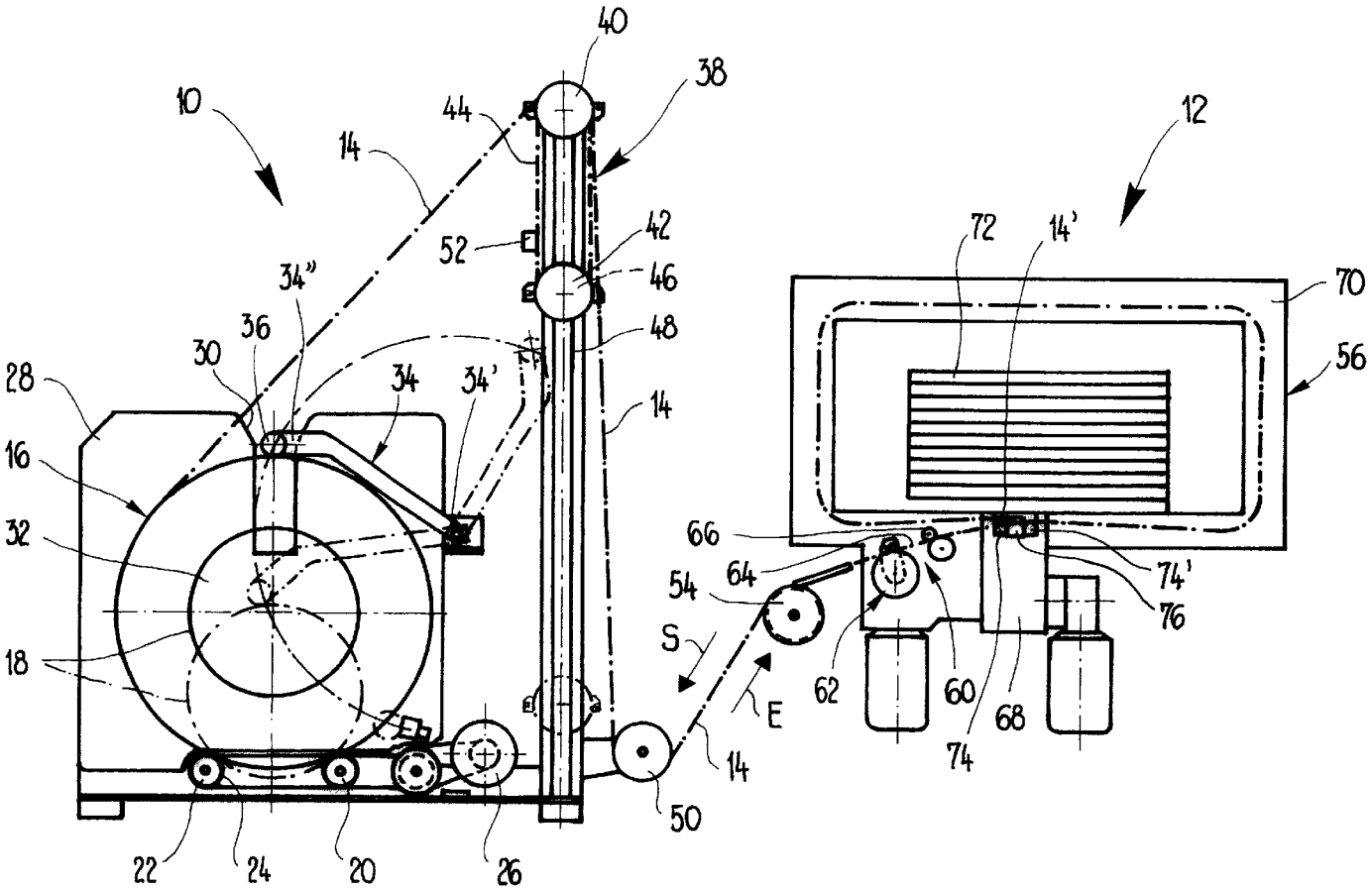
FIG. 4 shows a schematic side view of a strapping machine with associated unwinding apparatus.

As can best be seen with reference to FIGS. 1 and 4, the side walls 28 are provided with recesses 30 which are open in the upward direction and extend into the region of the central cavity 32 of the band-supply reel 16, said cavity being defined by the hollow-cylindrical core 18. With the band-supply reel 16 set down, the central cavity 32 is thus accessible in order for it to be possible, for example, for a carrying strap by means of which the band-supply reel 16 was fastened on the crane to be removed again. Thereafter, the band-supply reel 16 is loaded by a weight lever 34 which ensures that the band-supply reel 16, which becomes increasingly lighter in the direction of the end of the supply, or the remaining core 18 does not spring off from the bearing rollers 20, 22.

The weight lever 34 is mounted pivotably on the fixed side walls 28 at one end 34'. At its other, free end 34", it is provided with rollers 36 via which it rests on the band-supply reel 16.

The band 14 unwound from the band-supply reel 16 is guided obliquely upward, beyond the band-supply reel 16, to an intermediate band store 38 via which the band 14 unwound from the band-supply reel 16 is fed to the strapping machine 12 and kept taut (see, in particular, FIG. 4).

As is described in more detail hereinbelow, the drive of the band-supply reel 16, said drive comprising the electric motor 26, can be activated via a corresponding control means depending upon the respective state of the intermediate band store 38 and/or the quantity of band material stored in the intermediate band store 38.

In the present case, the intermediate band store 38, in the manner of a block and tackle, comprises at least two deflecting rollers 40, 42 over which the unwound band 14 is guided, with a reserve band supply 44 being formed in the process (see, in particular, FIG. 4), there being provided at least one top deflecting roller 40, which is mounted in a stationary manner, and at least one bottom deflecting roller 42, which can be displaced in the vertical direction. In the present case, there are provided four top deflecting rollers 40, which are mounted in a stationary and equiaxial manner, and three bottom, vertically displaceable deflecting rollers 42, which are mounted in an equiaxial manner. The bottom deflecting rollers 42 are mounted on a carriage 46 which can be displaced in the vertical direction along a carriage guide 48. For the purpose of forming the reserve band supply 44, the band 14 is guided correspondingly around the top and bottom deflecting rollers 40 and 42, respectively.

Starting from the band-supply reel 16, the band first of all runs onto one of the top deflecting rollers 40. Finally, the band 14 then runs from one of the top deflecting rollers 40 to a bottom, stationary roller 50 in order to be fed over the latter to the strapping machine 12.

In the present case, the drive of the band-supply reel 16, said drive comprising the electric motor 26, can be activated in dependence on the vertical position of the bottom deflecting rollers 42 or of the carriage 46. In this case, said drive of the band-supply reel 16 can be activated such that it is switched on if the bottom deflecting rollers 42 or the carriage 46 assume/assumes a predeterminable position, or are/is located above the latter, and is switched off if the bottom deflecting rollers 42 or the carriage 46 are/is located beneath said predeterminable position.

For this purpose, it is possible to provide at least one vertically adjustable sensor 52 preferably assigned to the carriage guide 48 (see, in particular, FIGS. 1 and 4). Via the vertically adjustable sensor 52, it is thus possible for the drive of the bearing rollers 20, 22 and thus of the band-supply reel 16 to be controlled correspondingly, for which purpose the sensor 52 can be connected to the abovementioned control means.

If the bottom deflecting rollers 42 or the carriage 46 are/is located at the sensor 52 or above said sensor 52, then the electric motor 26 drives the band-supply reel 16. If said deflection rollers or said carriage are/is located beneath the sensing range of the sensor 52, then the drive motor 26 is switched off. The circumferential speed of the driven bearing rollers 20, 22 and thus the unwinding speed of the band 14 preferably corresponds at least approximately to the speed at which the band 14 is drawn into the strapping machine 12.

As can be seen, in particular, with reference to FIG. 4, the bottom, stationary roller 50 may be mounted on the carriage guide 48.

According to FIG. 4, following the bottom, stationary roller 50, the band 14 is fed, via a deflecting subassembly 54, to a strapping subassembly 56 of the strapping machine 12.

It can also be seen with reference to FIG. 4 that the strapping machine 12 or the strapping subassembly 56 thereof comprises a band introduction and tensioning subassembly 60, which is provided with a tensioning apparatus 62 for the final tensioning of the, for example, plastic band 14. A pair of conveying rollers 66 connected to a reversible drive is arranged in the region of a guide channel 64. Said pair of conveying rollers is intended for feeding the band 14, which comes from the unwinding apparatus 10 and is guided through the tensioning apparatus 62, in an advancement direction, which is counter to the tensioning direction S, through a clamping and sealing subassembly 68 and into a guide frame 70, with the free band end 14' in front, until said band end 14' is positioned against a stop in the clamping and sealing subassembly 68. The guide frame 70 runs around the item 72 which is to be strapped. The pair of conveying rollers 66 is also intended for drawing back in the tensioning direction S the band 14, which has been guided around the item 72 which is to be strapped and is clamped firmly, by means of a first band-clamping unit 74 of the clamping and sealing subassembly 68, at a distance from the band end 14', which is positioned against the stop, until said band has been positioned against the item 72 which is to be strapped.

The clamping and sealing subassembly 68 has a second band-clamping unit 74' and, between the band-clamping unit 74 and 74', a welding unit 76.

Once the pair of conveying rollers 66 has drawn back the band 14 in the tensioning direction S and has positioned the same against the item 72 which is to be strapped, the tensioning apparatus 62 takes effect, as a result of which the band 14 is gripped and tensioned to the predetermined tensioning force. As soon as this has been achieved, the clamping and sealing subassembly 68 takes effect, in that the second band-clamping unit 74' clamps the band 14 firmly and the welding unit 76 welds the two overlapping sections of the band 14 to one another by heating and clamping. Thereafter, the band 14 is severed downstream of the welding location, as seen in the tensioning direction, by means of the clamping and sealing subassembly 68.

The unwinding apparatus 10 functions as follows:

The bottom deflecting rollers 42 are located in a position beneath the sensor 52. The, band material 14 is drawn into the strapping machine 12 in the direction of the arrow E, then the bottom, vertically displaceable deflecting rollers 42 are raised until they pass into the region of the sensor 52. The drive motor 26 then drives the band-supply reel 16. As a result of the abovementioned speed conditions, the bottom, vertically displaceable deflecting rollers 42 remain fixed in the region of action of the sensor 52. As soon as the strapping machine 12 then stops the drawing-in operation of the band, the bottom deflecting rollers 42 move downward out of the sensing range of the sensor 52, which results in the drive motor 26 being switched off via the associated control means. As the band 14 is positioned against the item 72 which is to be strapped, the strapping machine 12 supplies band material back to the intermediate band store or accumulator 38, as a result the vertically displaceable deflecting rollers 46 move in the downward direction. This sequence is repeated during the next strapping cycle.

In this unwinding apparatus 10, the speed of unwinding from the band-supply reel 16 is always the same irrespective of the diameter of the reel 16, this being achieved due to band-supply reel 16 resting directly on the bearing rollers 20, 22. The large heavy band-supply reels of, for example, approximately 70 kg can be handled easily and it is possible to provide an extremely large band supply. The outlay in control terms is minimal. The rubber casing 24 on the downstream bearing roller 22 prevents band sections from bulging out between the two bearing rollers 20, 22. The side walls 28 give the band-supply reel 16 the desired stability. The band-supply reel 16 may be rolled onto the bearing rollers 20, 22, for example, between the side walls 28.

The unwinding speed is expediently always kept constant, i.e. the electric motor is always operated at the same rotational speed. It is also possible, in principle, for the drawing-in speed in the region of the strapping machine to be higher or lower than the unwinding speed.

What is claimed is:

1. An unwinding apparatus for a strapping machine for the purpose of unwinding a band from a band-supply reel, the unwinding apparatus comprising:

at least two bearing rollers located one behind the other in a rotational direction of the band-supply reel and on which at least two bearing rollers an outer circumference of the band-supply reel rests, a downstream bearing roller of the at least two bearing rollers being provided with a reel contacting rubber casing and being driven for driving the band-supply reel;

an intermediate band store with a first roller which is stationary, a second roller located downstream of the first roller and movable relative to the first roller over which rollers the band is guided with a reserve band supply being formed between the first roller and the second roller and a sensor located between the first roller and a bottom of the intermediate band store to detect a predetermined position of the second roller, the second roller adapted to be movable between the first roller and the bottom, wherein driving of the band-supply reel is activated when the second roller assumes the predetermined position or is located above the predetermined position and the band-supply reel is deactivated when the second roller is located beneath the predetermined position; and a band introduction and tensioning subassembly downstream of the intermediate band store for final tensioning of the band introduced to the strapping machine, and for returning the band to the intermediate band store after a strapping operation by the strapping machine, so that the second roller moves toward the bottom of the intermediate band store.

2. The unwinding apparatus as claimed in claim 1, wherein the upstream bearing roller has a reel contacting surface made of steel.

3. The unwinding apparatus as claimed in claim 1, further comprising two fixed side walls which have a height no less than a height of the band-supply reel and the band-supply reel is lowered between the two fixed side walls and onto the bearing rollers.

4. The unwinding apparatus as claimed in claim 3, wherein the side walls are provided with recesses which are open in an upward direction and extend into a region of a central cavity of the band-supply reel, the cavity being defined by a hollow-cylindrical core.

5. The unwinding apparatus as claimed in claim 3, wherein at least one weight lever is provided in order to load the band-supply reel downward toward the bearing rollers, the weight lever being mounted pivotably on the fixed side walls.

6. The unwinding apparatus as claimed in claim 1, wherein the second roller is mounted on a carriage which carriage can be displaced in the vertical direction along a carriage guide.

7. The unwinding apparatus as claimed in claim 1, wherein the circumferential speed of the at least one driven bearing roller is at least essentially equal to the speed at which the band is drawn into the strapping machine.

8. A method of unwinding a band from an unwinding apparatus to strap an item in a strapping machine, the method comprising:

providing a band-supply reel having a band, the band having an outer circumference;

resting the outer circumference of the band on at least two bearing rollers, the at least two bearing rollers being located one behind the other in a rotational direction of the band-supply reel, and one of the at least two bearing rollers having a rubber casing contacting the band on the band supply reel and being driven;

feeding the band to an intermediate band store with a first roller which is stationary, a second roller located downstream of the first roller and movable relative to the first roller over which rollers the band is guided with a reserve band supply being formed between the first roller and the second roller and a sensor located between the first roller and a bottom of the intermediate band store to detect a predetermined position of the second roller, the second roller adapted to be movable between the first roller and the bottom, wherein driving of the band-supply reel is activated when the second roller assumes the predetermined position or is located above the predetermined position and the band-supply reel is deactivated when the second roller is located beneath the predetermined position;

feeding the band to an introduction and tensioning subassembly;

strapping the item in the strapping machine;

applying a final tensioning to the band around the item in the strapping machine; and returning the band from the band introduction and tensioning subassembly to the intermediate band store after the strapping operating by the strapping machine in order to move the second roller toward the bottom of the intermediate band store.

* * * * *